United States Patent [19]

Bridges

[11] Patent Number: 4,771,832

[45] Date of Patent: Sep. 20, 1988

[54] WELLHEAD WITH ECCENTRIC CASING SEAL RING

[75] Inventor: Charles D. Bridges, Houston, Tex.

[73] Assignee: Vetco Gray Inc., Houston, Tex.

[21] Appl. No.: 130,757

[22] Filed: Dec. 9, 1987

[51] Int. Cl.[4] ..... E21B 33/04; F16L 19/02

[52] U.S. Cl. ..... 166/380; 166/82; 277/105; 277/144; 277/236; 285/178

[58] Field of Search ..... 166/82, 85, 86, 88, 166/387, 341, 343, 348, 360, 378–380; 285/178, 138, 139, 140; 277/236, 105, 117, 118, 144

[56] References Cited

U.S. PATENT DOCUMENTS

| | | | |
|---|---|---|---|
| 1,323,660 | 12/1919 | Thrift . | |
| 1,548,543 | 8/1925 | Moody . | |
| 2,179,814 | 11/1939 | Conaghan . | |
| 3,895,831 | 7/1975 | Fisher | 285/93 |
| 3,899,200 | 8/1975 | Gamble | 285/178 X |
| 4,131,287 | 12/1978 | Gunderson et al. | 277/191 |
| 4,390,186 | 6/1983 | McGee et al. | 277/236 |
| 4,556,224 | 12/1985 | Le | 277/118 |
| 4,569,540 | 2/1986 | Beson | 285/93 |
| 4,646,845 | 3/1987 | Boeker | 166/387 |
| 4,650,225 | 3/1987 | Le et al. . | |
| 4,650,226 | 3/1987 | Babbitt et al. | 285/348 |
| 4,678,209 | 7/1987 | Guice | 285/144 |

*Primary Examiner*—Stephen J. Novosad
*Attorney, Agent, or Firm*—James E. Bradley

[57] ABSTRACT

A wellhead assembly has a metal seal that accommodates misalignment between casing and the bore of the wellhead housing. The metal seal assembly includes a metal seal ring and a wedge ring. The seal ring has a cylindrical inner wall and a conical outer wall. The centerlines of the inner and outer walls are offset with respect to each other, making the ring eccentric. Similarly, the wedge ring has a conical inner wall and an outer wall. Its inner and outer walls are offset with respect to each other. The rings can be rotated relative to each other and to the casing to coincide the axis of the outer wall of the wedge ring with the axis of the wellhead housing bore. The inner wall of the seal ring has protruding bands which deform as a result of the softness of the metal to enhance sealing.

5 Claims, 4 Drawing Sheets

WELLHEAD WITH ECCENTRIC CASING SEAL RING

BACKGROUND OF THE INVENTION

1. Field of the Invention

This invention relates to casing seals for wellheads, and in particular to a metal seal for sealing between the casing and the wellhead bore.

2. Description of the Prior Art

In a completed oil or gas well, one or more strings of casing is cemented in the well. A wellhead housing is located at the surface for supporting the upper end of the casing. The wellhead housing includes a lower portion through which the casing protrudes upwardly. A casing hanger supports the casing in the lower wellhead housing. After cementing, the upper end of the casing is cut off a selected distance above the lower wellhead housing.

An upper wellhead housing is bolted to the upper end of the lower wellhead housing. The upper wellhead housing has a bore that receives the upper end of the casing. A casing seal seals the upper end of the casing to the bore of the upper wellhead housing to prevent leakage from the annulus between the casing and the upper wellhead housing.

Frequently, the axis of the casing will be slightly off center relative to the axis of the bore of the upper wellhead housing. Because the casing is cemented in the well, it cannot be moved to change the axial alignment. With elastomeric seals, slight misalignment presents no great problem. Many wells, now, however, have metal seals. Metal seals are longer lasting and are not subject to deterioration from certain well fluids to the extent that elastomeric seals may be. However, a metal seal requires a very precise fit in order to accomplish sealing.

In the prior art technique the upper end of the casing is machined at the well site until it is coaxial with the bore of the upper wellhead housing. The metal seal is then located in place. While this technique works, it is expensive and time-consuming to machine the casing at the field site.

SUMMARY OF THE INVENTION

In this invention, field machining of the casing is not necessary. The metal seal ring has a cylindrical inner wall and a conical outer wall. The inner and outer walls are formed eccentric to each other. The centerline of the outer wall is offset a slight distance from the centerline of the inner wall.

A wedge ring fits around the seal ring to force it into tight engagement with the casing. The wedge ring has conical inner and outer walls that are eccentric with one another. The two rings may be rotated relative to one another until the centerline of the inner wall of the seal ring coincides with the axis of the upper wellhead bore, or is placed eccentrically by relative rotation to align with the axis of the suspended casing. This provides precise alignment for the metal seal. Also, preferably, the inner wall of the seal ring has a plurality of annular protrusions or bands. These bands are of softer metal than the casing and deform to provide a good seal.

DESCRIPTION OF THE PREFERRED EMBODIMENT

Figure 1:
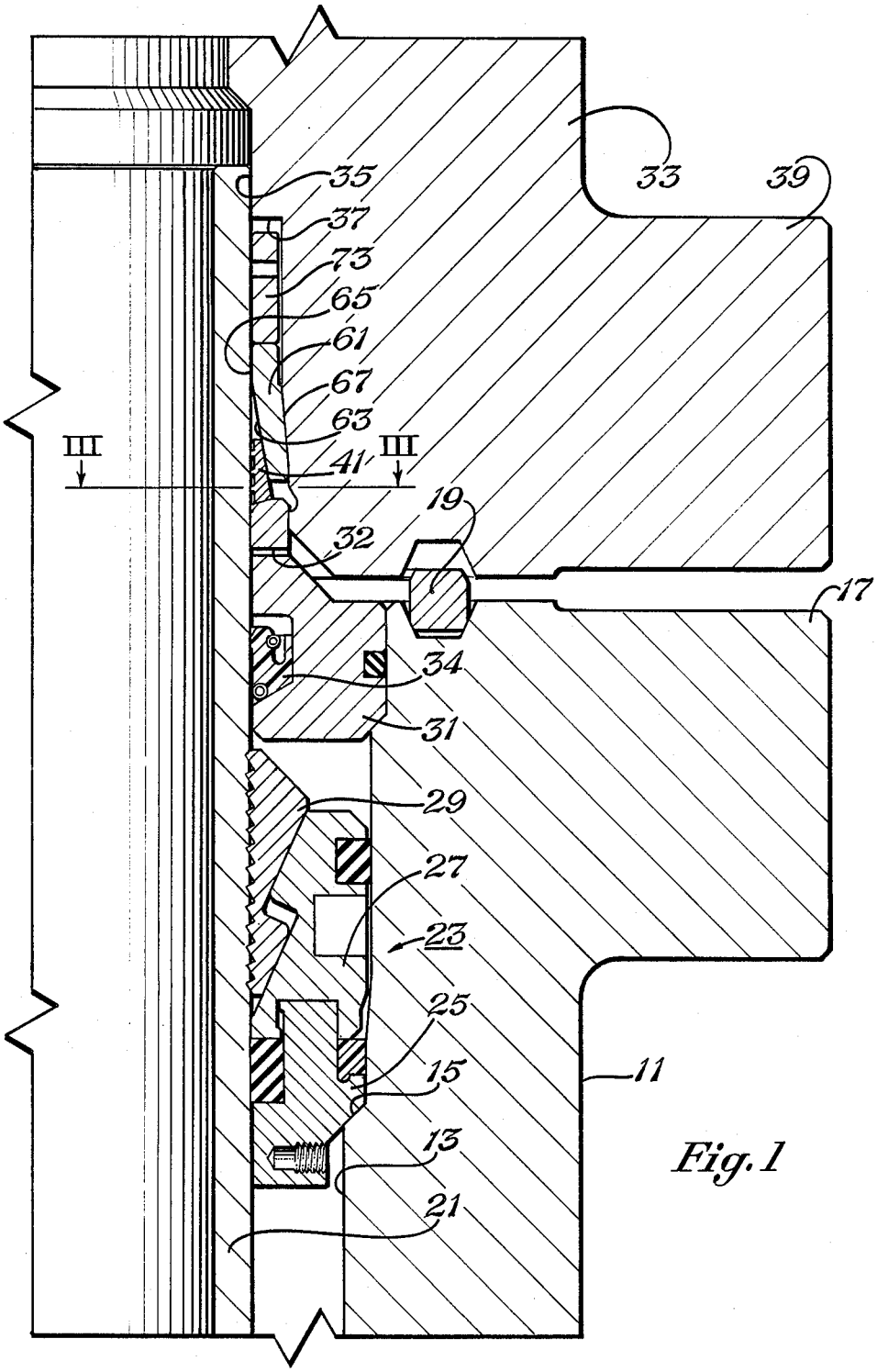
FIG. 1 is a partial vertical sectional view illustrating a wellhead assembly constructed in accordance with this invention, and showing the seal prior to actuation.

Referring to FIG. 1, the wellhead assembly includes a lower wellhead housing 11. Lower wellhead housing 11 is a tubular member, having an axial bore 13. A landing shoulder 15 is located in the bore 13. An external flange 17 is located on the upper end of the lower wellhead housing 11. A metal seal 19 is located on the upper end of the flange 17.

A string of casing 21 extends through the lower wellhead housing 11. Casing 21 is supported on the lower wellhead housing 11 by a casing hanger 23. casing hanger 23 is conventional and is installed after the casing 21 has been cemented. It includes a landing ring 25 that lands on the landing shoulder 15. The casing hanger 23 includes a wedge ring 27 located above the landing ring 25. A plurality of slips 29 are carried by the wedge ring 27. The slips 29 are pushed inward by the inclined surfaces located between the wedge ring 27 and the slips 29. This causes teeth on the slips 29 to bite into the casing 21 and provide support.

A test ring 31 of conventional design is located in the bore 13 above the hanger 23. The test ring 31 has a passage 32 extending between the inner and outer walls of the test ring 31. Test ring 31 is sealed between the bore 13 and the casing 21 by elastomeric seals 34.

An upper wellhead housing 33 lands on the lower wellhead housing 11. Upper wellhead housing 33 has an axial bore 35 that is coaxial with the bore 13 of the lower wellhead housing 11. The upper wellhead housing 33 has a downward facing shoulder 37 located in the bore 35. A flange 39 is formed on the lower end of the upper wellhead housing 33 for connection to the flange 17 of the lower wellhead housing 11. The flanges 17, 39 and bolts (not shown) serve as means for connecting the upper wellhead housing 33 to the lower wellhead housing 11. A passage (not shown) extends from the exterior to the passage 32 in the test ring for test purposes.

Figure 2:
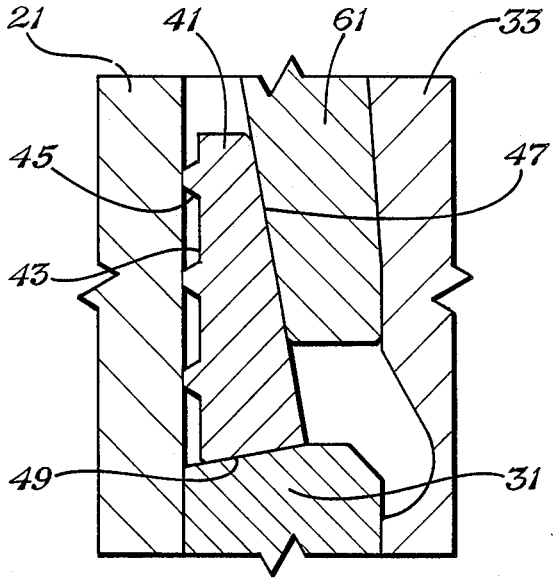
FIG. 2 is an enlarged partial sectional view of the seal ring of the wellhead assembly of FIG. 1.

A seal ring 41 is located in the upper wellhead housing bore 35 above the test ring 31. Referring to FIG. 2, the seal ring 41 has an inner wall 43 that is cylindrical. A plurality of annular protrusions or bands 45 protrude inward from the inner wall 43. The bands 45 are spaced apart from each other and protrude inward only a slight distance, about 0.040 inch. Each band 45 has frustoconical upper and lower surfaces, and a cylindrical inner diameter or crest.

The seal ring 41 is solid and is constructed of metal, preferably steel. Also, preferably, the steel is softer than the steel of the casing 21. Typical casing may have a yield strength of 55 to 60,000 psi. Preferably, the yield strength of the seal ring 41 will be about half of the yield strength of the casing 21. This results in the bands 45 deforming permanently when the seal ring 41 is actuated.

Referring still to FIG. 2, seal ring 41 has an outer wall 47 that is frusto-conical. It inclines from a smaller diameter on the upper end to a larger diameter on its lower end. The lower edge 49 of seal ring 41 is also a frusto-conical surface. It tapers downward from the outer wall 47 to the inner wall 43.

Figure 3:
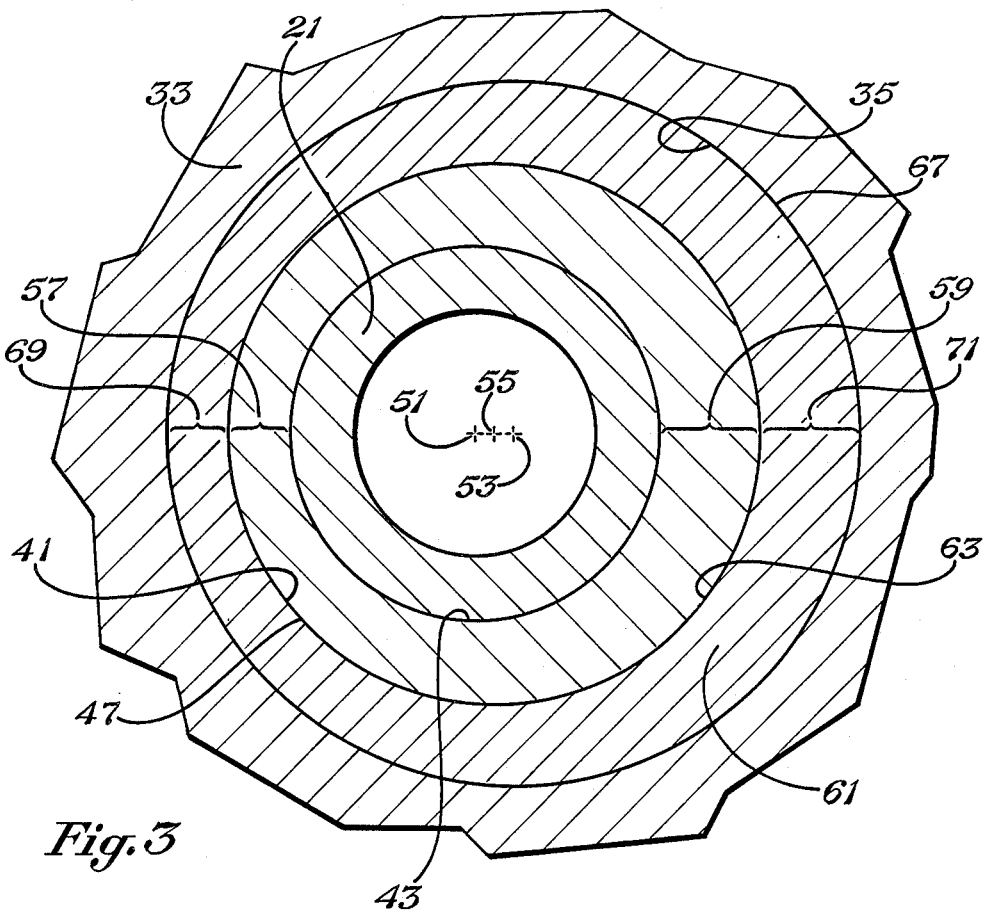
FIG. 3 is a partial sectional view of the wellhead assembly of FIG. 1, taken along the line III-III of FIG. 1.

Referring to FIG. 3, the seal ring 41 has a centerline which coincides with the centerline or axis 51 of the casing 21. The axis 51, however, frequently will be offset a slight distance from the axis 53 of the upper wellhead housing bore 35. In FIG. 3, the casing axis 51 is shown offset to the left from the bore axis 53. FIG. 3 is exaggerated greatly, as the amount of offset will normally be less than 0.100 inch.

To accommodate the misalignment of the casing 21 with the upper wellhead housing 33, the seal ring 41 is formed eccentric. The outer wall 47 is truly conical, but its axis or centerline 55 is offset from the centerline of the inner wall 43, which coincides with axis 51 of casing 21. This results in the radial thickness of the seal ring 41 varying. The seal ring 41 will have a point 57 of mimimum thickness. A point 59 of maximum thickness will be located 180 degrees from the point 57. The amount of offset between the centerline of the inner wall 43 and the centerline 55 of the outer wall 47 is preferably 0.050 inch.

The seal ring is actuated with assistance of a wedge ring 61, as shown in FIG. 1. Wedge ring 61 has a conical inner wall portion 63. The inner wall portion 63 extends downward from a cylindrical inner wall portion 65. The cylindrical inner wall portion 65 is sufficiently greater in diameter than the outer diameter of the casing 21 to accommodate normal misalignment. The cylindrical inner wall portion 65 does not form a sealing function and is also larger in diameter than the inner wall 43 (FIG. 2) of the seal ring 41. The wedge ring 61 has an outer wall 67 that is conical and which is adapted to seal against the upper wellhead housing bore 35. The degree of taper of the conical outer wall 67 is less than the degree of taper of the inner wall 63. The degree of taper of the outer wall 67 is the same as a conical portion provided in the bore 35 of the upper wellhead housing 33.

One or more sealing bands (not shown) are located on the outer wall 67 for sealing against the bore 35. Wedge ring 61 is not significantly softer than the upper wellhead housing 33 and the bands do not deform.

Referring to FIG. 3, the wedge ring 61 is also formed eccentric. The centerline for the inner wall portion 63 will be offset from the centerline for the outer wall 67. The amount of offset is also about 0.050 inch. This results in a variance in iadial thickness. The minimum thickness point 69 will be located 180 degrees from a maxiumum thickness point 71. The centerline for the inner wall portion 63 will coincide with the centerline 55 for the seal ring outer wall 47. The seal ring 41 and wedge ring 61 are rotatable relative to each other and to the casing 21 to position the centerline for the outer wall portion 67 in alignment with the upper wellhead bore axis 53. Referring again to FIG. 1, a drive ring 73 is located between the wedge ring 61 and the shoulder 37 of the upper wellhead housing 33.

In operation, the casing hanger 23 is mounted in the lower wellhead housing 11 to support the casing 21 after the casing 21 has been cemented in place. The test ring 31 will be positioned in place. The upper end of the casing 21 will be cut off a selected distance above the lower wellhead housing 11.

The exterior of the casing 21 above the test ring 31 is wire brushed and smoothed with emery cloth. The axis 51 (FIG. 3) of the casing 21 is measured relative to the axis of the lower wellhead housing bore 13 to determine any misalignment. The axis 53 of the upper wellhead housing 33 will always be in alignment with the axis of the lower wellhead housing bore 13.

The seal ring 41 and the wedge ring 61 are placed over the casing 21. Both rings 41 and 61 may be rotated, but normally only one of the rings 41, 61 will be rotated. Rotation is performed until the centerline of the outer wall portion 67 of the wedge ring 61 coincides with the bore axis 53. Markings will be located on the wedge ring 61 and the seal ring 41 to indicate the extent of rotation relative to each other. The point of maximum eccentricity is shown in FIG. 3, with the minimum points 57, 69 aligned with each other. Zero eccentricity results when one of the rings 41, 61 is rotated 180 degrees from the position shown in FIG. 3. In that case, the casing centerline 51 and axis 53 coincide, indicating no misalignment. The equal degree of offset of 0.050 inch in each ring 41, 61 cancels each other in such a case. If one ring 41, 61 is rotated 90 degrees from the position shown in FIG. 3, the offset of the casing centerline 51 with the bore axis 53 will be one-half the maximum, or 0.050 inch. The eccentric offset of the seal ring 41 and the wedge ring 61 will enable the rings 41, 61 to be properly positioned as long as the misalignment of the casing centerline 51 with the bore axis 53 does not exceed 0.100 inch. This allows the centerline of the outer wall 67 of the wedge ring 61 to align perfectly with the bore 35.

Figure 4:
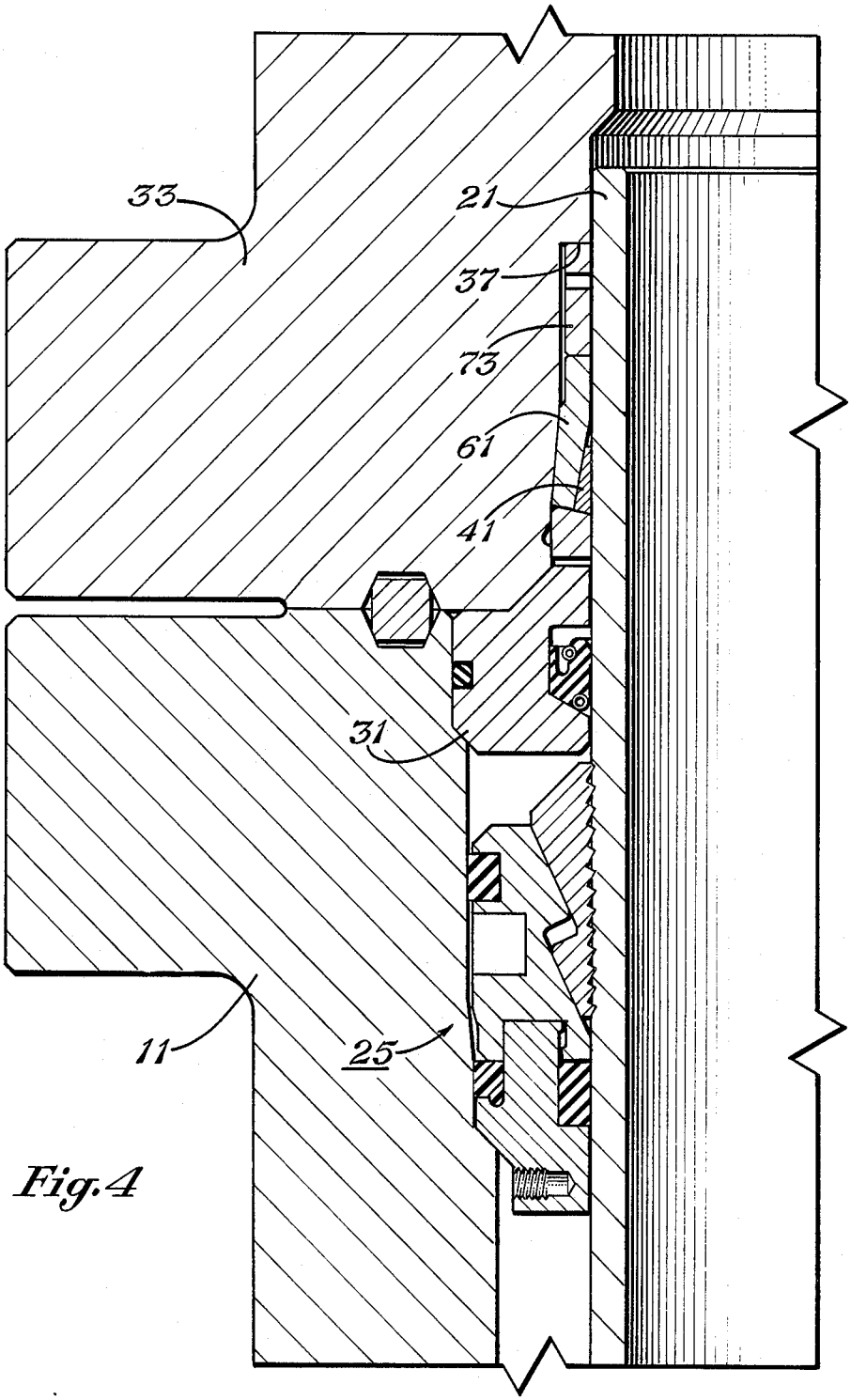
FIG. 4 is a partial vertical sectional view of the wellhead assembly of FIG. 1, and showing the seal actuated.

Once aligned, as shown in FIGS. 1 and 3, the upper wellhead housing 33 is bolted to the lower wellhead housing 11. The upper wellhead housing shoulder 37 bears down on the drive ring 73, which in turn pushes downward on the wedge ring 61. The wedge ring 61 pushes the seal ring 41 inward with great force. This causes the bands 45 (FIG. 2) to permanently flatten and deform. This deformation seals any pits or scratches in the casing 21 while also mating in a gas tight seal. The outer wall 67 of the wedge ring 61 forms a tight metal seal with the bore 35. The wedge ring 61 in normal cases will not deform. The actuated position is shown in FIG. 4.

The upper wellhead housing 33 may be removed, along with the seal ring 41 at a later date. A replacement seal may be used. Because of the softness of the seal ring 41 relative to the casing 21, there will be no need to machine the casing 21 when replacing the seal ring 41. No damage to the casing 21 will occur as a result of the actuation of the seal ring 41.

Figure 5:
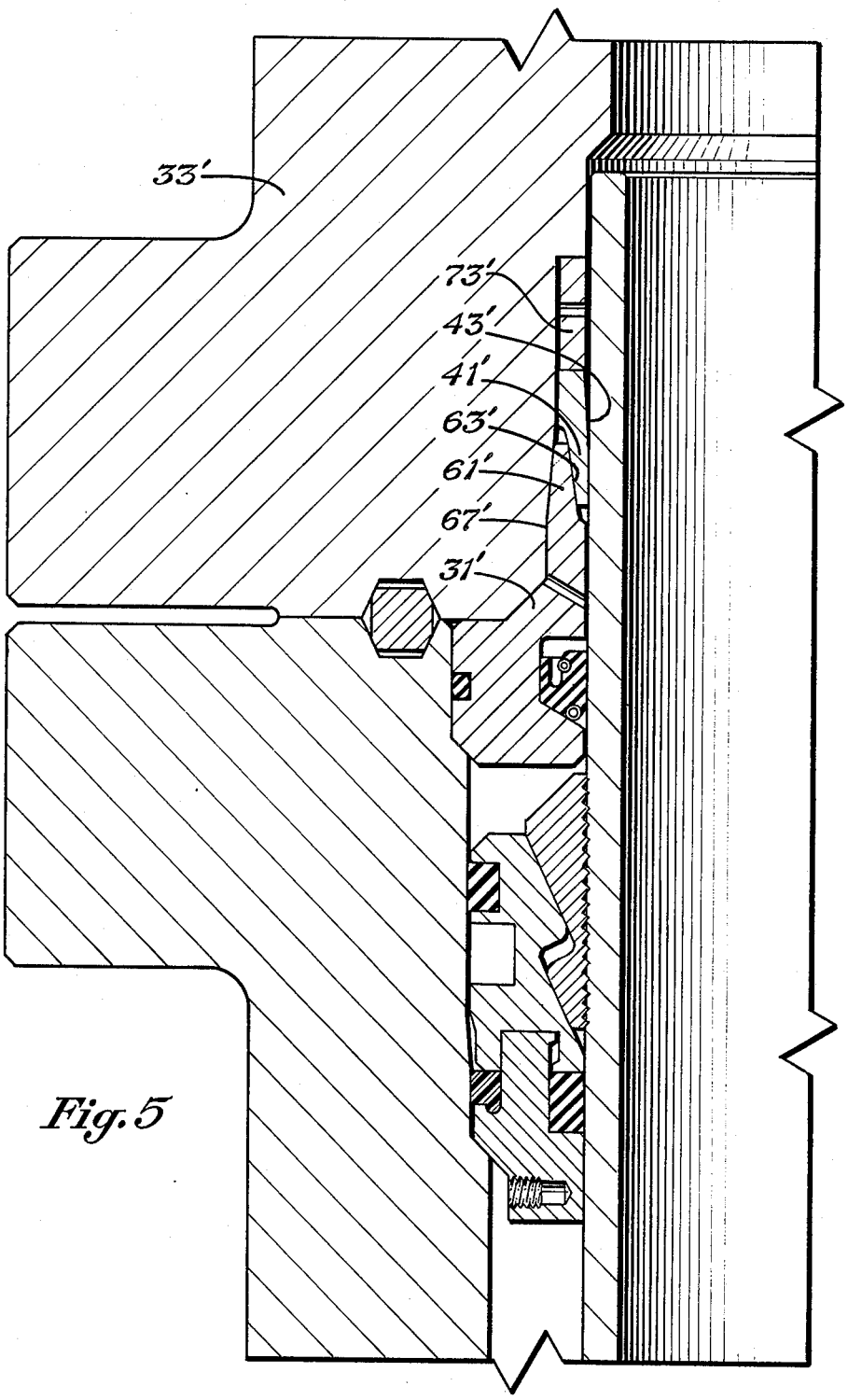
FIG. 5 is a partial vertical sectional view of an alternate embodiment of a wellhead assembly constructed in accordance with this invention.

In the alternate embodiment of FIG. 5, many of the components are the same. Components that differ slightly will be indicated by a prime symbol. In this embodiment, the wedge ring 61' is integrally formed to the top of the test ring 31'. Similarly, it has a conical outer wall portion 67' and a conical inner wall 63'. The conical inner wall 63', however, tapers upwardly to a larger diameter on the upper end than on the lower end. In this respect, the wedge ring 61' is inverted from the wedge ring 61 shown in FIGS. 1–4. Similarly, the centerline (not shown) of the inner wall 63' will be offset from the centerline of the outer wall 67'.

The seal ring 41' also is inverted. It has a cylindrical inner wall 43' and a conical outer wall 47'. The conical outer wall 47', however, tapers downward from a larger diameter on the upper end than on the lower end.

The drive ring 73' moves the seal ring 41' downward during actuation. This differs from the first emodiment in that the wedge ring 61 is moved by the drive ring 73, rather than the seal ring 41. In other respects, the embodiment in FIG. 5 operates in the same manner. Rotation of the wedge ring 61' is handled by rotating the entire test ring 31'. The rings 41', 61' are rotated until the centerline of the outer wall 67' coincides with the axis of the upper wellhead housing 33'.

The invention has significant advantages. The eccentric wedge and seal rings allow a metal seal to be made easily between casing and a wellhead even though the casing is misaligned with the wellhead. The softness of the seal ring relative to the casing provides a tight seal even if minor imperfections in the surface of the casing exists. The softness also avoids marring the surface of the casing. This allows the seal to be replaced at a later date without refinishing needing to be done on the casing. The invention avoids the need for field machining of the casing.

While the invention has been shown in only two of its forms, it should be apparent to those skilled in the art that it is not so limited, but is susceptible to various changes without departing from the scope of the invention thereof.

I claim:

1. An apparatus for forming a metal seal between an outer wall of an inner tubular member and a bore of an outer tubular member, comprising in combination:

a metal seal ring having an inner wall adapted to be positioned around the inner tubular member, and a conical outer wall, the inner and outer walls each having a centerline, the centerline of the inner wall being radially offset from the centerline of the outer wall;

a metal wedge ring having a conical inner wall portion adapted to engage the outer wall of the seal ring, and an outer wall adapted to engage the bore of the outer tubular member, the inner wall portion and the outer wall of the wedge ring each having a centerline, the centerline of the inner wall portion of the wedge ring being radially offset from the centerline of the outer wall of the wedge ring, allowing one of the seal ring and wedge ring to be rotated relative to the other to selected orientations relative to the inner tubular member to accommodate eccentricity of the inner tubular member relative to the bore in the outer tubular member; and means for moving one of the wedge ring and the seal ring toward the other to force the inner wall of the seal ring into sealing contact with the inner tubular member and to force the outer wall of the wedge ring into sealing engagement with the bore of the outer tubular member.

2. In well assembly having a string of casing, a wellhead housing located at the top of the well assembly and having a bore, hanger means for supporting the casing in the bore of the wellhead housing, an improved apparatus for forming a metal seal between the casing and the bore above the hanger means, comprising in combination:

a metal seal ring having an inner wall adapted to be positioned around the casing, and a conical outer wall, the inner and outer walls being eccentric with respect to one another;

a metal wedge ring having a conical inner wall portion adapted to engage the outer wall of the seal ring, and an outer wall adapted to engage the bore of the wellhead housing, the inner wall portion and the outer wall of the wedge ring being eccentric with respect to one another;

one of the wedge ring and seal ring being rotatable relative to the other to selected orientations relative to the casing to accommodate eccentricity of the casing relative to the bore in the wellhead housing; and means for moving one of the rings toward the other ring to force the inner wall of the seal ring into sealing contact with the casing and to force the outer wall of the wedge ring into sealing engagement with the bore of the wellhead housing.

3. In well assembly having a string of casing, a wellhead housing located at the top of the well assembly and having a bore, hanger means for supporting the casing in the bore of the wellhead housing, an improved apparatus for forming a metal seal between the casing and the bore above the hanger means, comprising in combination:

a metal seal ring having a cylindrical inner wall adapted to be positioned around the casing, and a conical outer wall, the seal ring being eccentric with a radial thickness that increases from a minimum point to a maximum point 180 degrees from the minimum point;

at least one circular protrusion formed on the inner wall of the seal ring, the protrusion being of a metal softer than the casing so as to be deformed against the casing to form a seal when forced inward;

a metal wedge ring having a conical inner wall portion adapted to engage the outer wall of the seal ring, and an outer wall adapted to engage the bore of the wellhead housing, the wedge ring being eccentric with a radial thickness that increases from a minimum point to a maximum point 180 degrees from the minimum point;

one of the wedge ring and seal ring being rotatable relative to the other to selected orientations relative to the casing to accommodate eccentricity of the casing relative to the bore in the wellhead housing; and means for moving one of the wedge ring and the seal ring toward the other to force the protrusion on the inner wall of the seal ring into sealing contact with the casing and to force the outer wall of the wedge ring into sealing engagement with the bore of the wellhead housing.

4. A wellhead assembly for supporting and sealing the upper end of casing, comprising in combination:

a lower wellhead housing through which the upper end of the casing protrudes;

hanger means in the lower wellhead housing for supporting the casing;

an upper wellhead housing having a bore, the upper wellhead housing adapted to land on top of the lower wellhead housing for receiving in the bore the upper end of the casing;

means for connecting the upper wellhead housing to the lower wellhead housing;

a metal seal ring having a cylindrical inner wall adapted to be positioned around the casing, and a conical outer wall, the inner and outer walls each having a centerline, the centerline of the inner wall being parallel to and radially offset from the centerline of the outer wall;

a metal wedge ring having a conical inner wall portion which is adapted to engage the outer wall of the seal ring, the wedge ring having an outer wall adapted to engage the bore of the upper wellhead housing, the inner wall portion and the outer wall of the wedge ring each having a centerline, the centerline of the inner wall portion of the wedge ring being parallel to and radially offset from the centerline of the outer wall of the wedge ring;

one of the wedge ring and the seal ring being rotatable relative to the other to selected orientations relative to the casing to accommodate eccentricity of the upper end of the casing relative to the bore in the upper wellhead housing; and means for moving one of the rings toward the other to force the inner wall of the seal ring into sealing contact with the casing and to force the outer wall of the wedge ring into sealing engagement with the bore of the upper wellhead housing as the upper wellhead housing is connected to the lower wellhead housing.

5. A method for forming a metal seal between casing and a bore in a wellhead housing, comprising in combination:

placing around the casing a metal seal ring having a cylindrical inner wall and a conical outer wall, the inner and outer walls each having a centerline, the centerline of the inner wall being radially offset from the centerline of the outer wall;

placing around the casing a metal wedge ring having a conical inner wall portion with the inner wall portion engaging the outer wall of the seal ring, the wedge ring having an outer wall, the inner wall portion and the outer wall of the wedge ring each having a centerline, the centerline of the inner wall portion of the wedge ring being radially offset from the centerline of the outer wall of the wedge ring;

rotating one of the seal ring and wedge ring relative to the other until the centerline of the outer wall of the wedge ring coincides with an axis of the bore of the wellhead housing to accommodate eccentricity of the casing relative to the bore; and moving one of the wedge ring and the seal ring toward the other to force the inner wall of the seal ring into sealing contact with the casing and to force the outer wall of the wedge ring into sealing engagement with the bore of the wellhead housing.

* * * * *

UNITED STATES PATENT AND TRADEMARK OFFICE

CERTIFICATE OF CORRECTION

PATENT NO. : 4,771,832

DATED : September 20, 1988

INVENTOR(S) : Charles D. Bridges

It is certified that error appears in the above-identified patent and that said Letters Patent is hereby corrected as shown below:

Column 2, line 28, "casing" should read -- Casing --.

Column 3, line 55, "iadial" should read -- radial --.

Signed and Sealed this

Twenty-second Day of August, 1989

*Attest:*

DONALD J. QUIGG

*Attesting Officer*

*Commissioner of Patents and Trademarks*